United States Patent [19]

Nagel et al.

[11] 4,284,221

[45] Aug. 18, 1981

[54] APPARATUS FOR BREAKING WEAKENED PORTIONS OF RUNNING WEBS OR THE LIKE

[75] Inventors: Erich Nagel, Anzing; Franz Ziegler; Ferdinand Schaner, both of Munich, all of Fed. Rep. of Germany

[73] Assignee: Agfa-Gevaert Aktiengesellschaft, Leverkusen, Fed. Rep. of Germany

[21] Appl. No.: 97,965

[22] Filed: Nov. 28, 1979

[30] Foreign Application Priority Data

Nov. 30, 1978 [DE] Fed. Rep. of Germany ..... 2851894

[51] Int. Cl.[3] ..... B26F 3/02

[52] U.S. Cl. ..... 225/100; 225/106

[58] Field of Search ..... 225/100, 106

[56] References Cited

U.S. PATENT DOCUMENTS

| | | | |
|---|---|---|---|
| 3,331,543 | 7/1967 | Kezeli | 225/100 X |
| 3,338,487 | 8/1967 | Schutz | 225/100 |
| 3,445,047 | 5/1969 | Sloan | 225/100 |
| 3,481,520 | 12/1969 | Pickering | 225/100 X |
| 3,672,551 | 6/1972 | Peterson | 225/100 |
| 3,789,571 | 2/1974 | Tall et al. | 225/100 X |
| 3,792,807 | 2/1974 | Mare et al. | 225/100 |
| 4,091,978 | 5/1978 | Graham | 225/100 |

*Primary Examiner*—Frank T. Yost

*Attorney, Agent, or Firm*—Peter K. Kontler

[57] ABSTRACT

Apparatus for separating successive sections of a running web wherein neighboring sections are connected to each other by weakened (e.g., perforated) web portions has a first and a second web driving unit. The second unit is located behind the first unit, as considered in the direction of transport of the web, and its speed is reduced below the speed of the first unit (and/or the speed of the first unit is increased above that of the second unit) when a weakened portion is located between the two units. This results in automatic separation of the preceding section because the tensional stress upon the weakened portion behind the preceding section suffices to destroy such weakened portion. The weakened portions are monitored by a detector which transmits short-lasting signals to change the speed of the first and/or second unit when a weakened portion advances beyond the second unit but is yet to reach the first unit. When a separating step is completed, the speed of the two units is again the same.

23 Claims, 4 Drawing Figures

APPARATUS FOR BREAKING WEAKENED PORTIONS OF RUNNING WEBS OR THE LIKE

BACKGROUND OF THE INVENTION

The present invention relates to apparatus for separating neighboring sections of a web, strip or tape from each other. More particularly, the invention relates to improvements in apparatus wherein a web, strip or tape (hereinafter called web for short) consists of or includes neighboring sections which are connected to each other by weakened web portions, e.g., by web portions which have lines of perforations extending substantially transversely of the longitudinal direction of the web. For example, the sections of the web may constitute envelopes or pockets for storage of severed portions of exposed and developed photographic customer films, prints made from photographic films and/or analogous sheet-like commodities. Pockets of the just outlined character are utilized by many processing laboratories to return developed customer films and prints (if any) to dealers or directly to customers.

It is already known to separate successive sections of a moving web wherein the sections are connected to each other by weakened portions of the web by transporting the web lengthwise by two advancing units including a driven front unit and a driven rear unit whose speed is less than the speed of the front unit. Consequently, a weakened portion breaks automatically as soon as it advances beyond the rear unit so that the section ahead of such weakened portion begins to advance at a speed which exceeds the speed of the section behind the weakened portion. The distance between the two advancing units (each of which normally comprises a pair of rollers disposed at the opposite sides of the path for the web) is somewhat greater than the length of a section, as considered in the longitudinal direction of the web. A drawback of such conventional apparatus is that the distance between the front and rear advancing units must be changed whenever a web with relatively short sections is to be followed by a web with longer sections. Moreover, the apparatus are bulky because the distance between the advancing units must exceed the length of a section. All this contributes to the initial and maintenance cost. Also, the operation must be interrupted whenever a web with sections having a first length is followed by a web with sections having a different second length.

OBJECTS AND SUMMARY OF THE INVENTION

An object of the invention is to provide a novel and improved apparatus which need not be adjusted when the separation of sections in a web with sections having a first length is to be followed by similar treatment or subdivision of a web having sections of a different (greater or lesser) length.

Another object of the invention is to provide an apparatus which is simpler, more compact and less expensive than heretofore known apparatus for breaking a running web along successive or selected lines of perforations extending transversely of the longitudinal direction of the web.

A further object of the invention is to provide an apparatus which can be operated at a high speed, wherein webs with longer sections can be followed by webs with shorter sections or vice versa, and which can be used for processing or a variety of webs including those made of paper, lightweight cardboard, synthetic plastic material, textile material, metallic foil and/or a combination of such materials.

An additional object of the invention is to provide an apparatus which can be used with particular advantage in photographic processing laboratories.

One feature of the invention resides in the provision of an apparatus for separating sections of an elongated web wherein the neighboring sections are connected to each other by elongated weakened portions (e.g., portions which are weakened by lines of perforations extending transversely of the longitudinal direction of the web). The apparatus comprises means for transporting the web lengthwise in a predetermined direction including a first web advancing unit and a second web advancing unit located behind the first unit (as considered in the direction of movement of the web), means for normally driving the two units at the same speed (i.e., at the same peripheral speed if each unit includes a pair of rollers disposed at the opposite sides of the path of movement of the web), and regulating means which is actuatable to vary the speed of at least one of the units, so that the speed of the first unit exceeds the speed of the second unit while a weakened portion (which is to be broken or destroyed) is located between the first and second units. The sections of the web may constitute envelopes for portions of exposed and developed photographic films, prints and/or analogous sheet-like commodities.

The apparatus further comprises means for monitoring the web and for actuating the regulating means whenever a weakened portion advances beyond the second unit but is still on its way toward the first unit. The monitoring means may include a photosensitive detector which can but need not be disposed between the first and second advancing units. For example, the monitoring means can scan the web for the presence or absence of weakened portions and includes means (e.g., the photosensitive transducer of a photocell) for generating actuating signals in response to detection of weakened portions. Alternatively, the web can be provided with markers (such as holes, black spots or other types of indicia) each of which is associated with and denotes a weakened portion, and the monitoring means then comprises a detector which has means for transmitting to the regulating means actuating signals in response to detection of markers.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
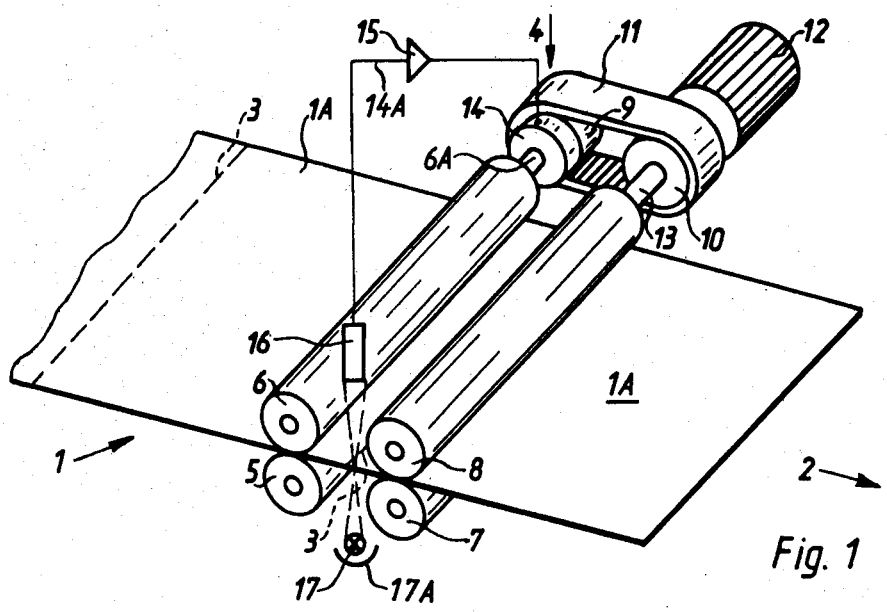
FIG. 1 is a perspective view of an apparatus which embodies one form of the invention.

Referring first to FIG. 1, there is shown an apparatus which is utilized to subdivide elongated flexible webs 1 along weakened portions 3 each of which includes a line of circular or otherwise configurated perforations. The weakened portions 3 extend transversely of the running web 1, namely, at right angles to the direction (arrow 2) of lengthwise movement of the web. Each weakened portion 3 is disposed between two web sections 1A, and each section may constitute an envelope (e.g., a pocket) for storage of portions of exposed and developed photographic films and/or prints. For example, the sections 1A can be used in photographic processing laboratories and may be provided with two compartments each. One compartment receives a stack of acceptable prints and other compartment receives a stack of film portions. It is well known that an exposed customer film which has been mailed, shipped or delivered to a processing laboratory is developed and thereupon subdivided into portions each of which includes a certain number (e.g., four or six) of film frames. Such portions are stacked and inserted into the other compartment of a pocket which is then shipped or mailed to or picked up by a dealer or directly by a customer. The pockets can be filled by automatic equipment, and each pocket is provided with information including the code number of the dealer and/or customer, the date of receipt of the customer order, the name of the dealer and/or customer, the cost of development and/or the making of prints, the date of completion of the order, the account of the customer or dealer and/or others.

It goes without saying that the web 1 may consist of a single layer of paper, metallic or plastic foil or other flexible material which is to be broken up into sections of desired length. Each section may constitute a form, a circular letter, a page of a pamphlet or book, a sheet of advertising material, etc. Also, the weakening need not be effected by lines of perforations or by perforations alone; for example, the web 1 can be creased at 3 so that it will readily break along a weakened portion in response to the application of longitudinal tensional stresses to the preceding section in a direction away from the next-following section and/or vice versa.

The apparatus of FIG. 1 comprises a web transporting system 4 which includes a first unit including two parallel driven advancing rollers 7, 8 and a second unit which is located behind the first unit (as considered in the direction of arrow 2) and includes parallel driven advancing rollers 5, 6. Thus, successive increments of a section 1A of the web 1 advance first through the nip of the rollers 5, 6, thereupon across the space between the rollers 5, 6 and 7, 8, and ultimately through the nip of the rollers 7, 8.

The roller 6 of the second or rear unit of the transporting system 4 is or can be driven at a predetermined speed by a prime mover, e.g., an electric motor 12. The roller 5 is driven by the web 1 in response to rotation of the roller 6. Analogously, the roller 8 is or can be driven by the motor 12, and the roller 7 is driven by the web 1 when the roller 8 rotates. The rollers 5 and 7 are or can be respectively biased against the rollers 6 and 8 in a manner which is not specifically shown in FIG. 1. The shafts 6A and 13 of the rollers 6 and 8 respectively carry driving wheels 9, 10 (e.g., sprocket wheels) which have identical outer diameters and are connected to each other by a toothed belt 11 or an analogous torque transmitting element. The outer diameters of the rollers 6 and 8 are the same as that, when the motor 12 is on and the wheel 9 is free to transmit full torque to the shaft 6A, the speed at which the web 1 is advanced by the rollers 5, 6 is the same as the speed of advancement of the web by the unit including the rollers 7, 8.

A speed regulating device 14 which is actuatable to change the speed of the roller 6 is mounted on the shaft 6A. This regulating device is a magnetic brake which reduces the speed of the rollers 5, 6 when a weakened portion 3 of the web 1 is located between the units 5, 6 and 7, 8. This ensures that the speed of the unit 7, 8 exceeds the speed of the unit 5, 6 whereby the weakened portion 3 in the space between the units 5, 6 and 7, 8 breaks in a fully automatic way, i.e., the preceding section 1A is separated from the next-following section and the separated preceding section is moved forwardly and away from the leader of the next-following section.

The magnetic brake 14 may constitute a clutch which is disengaged when it receives a signal via conductor means 14A so that the rollers 5, 6 come to a halt while the rollers 7, 8 continue to advance the section 1A therebetween in the direction of the arrow 2.

The means for monitoring the weakened portions 3 and for transmitting signals to the regulating device 14 via conductor means 14A comprises a detector in the form of a photocell which is installed between the units 5, 6 and 7, 8. The photocell comprises a light source 17 in front of a reflector 17A and a photosensitive transducer 16 whose output is connected with the conductor means 14A. The signals which are generated by the transducer 16 when one or more light beams issuing from the source 17 are free to penetrate through one or more perforations of a weakened portion 3 between the units 5, 6 and 7, 8 are amplified by an amplifier 15 which is installed in the conductor means 14A. The sensitivity of the detector or monitoring means including the light source 17 and the transducer 16 can be readily selected in such a way that the regulating device 14 invariably receives an actuating signal to reduce the speed of the unit 5, 6 (e.g., to zero) whenever a weakened portion 3 advances beyond the unit 5, 6 but is still distant from the unit 7, 8.

The operation of the apparatus of FIG. 1 is as follows.

The web 1 is transported in the direction of the arrow 2 because the motor 12 drives the roller 8 (directly via shaft 13 which is the output element of the motor) and because the regulating device 14 is not actuated, i.e., the motor 12 can drive the roller 6 via shaft 13, wheel 10, belt 11, wheel 9 and shaft 6A. When a weakened portion 3 advances into the gap between the light source 17 and the transducer 16 of the monitoring means, the transducer 16 transmits a signal which is amplified at 15 and is applied to the regulating device 14. The latter causes a reduction (to zero) of the speed of the roller 6 so that the weakened portion 3 breaks somewhere between the aforementioned gap and the nip of the unit 7, 8.

The wheel 9 continues to receive torque from the belt 11 so that it can set the roller 6 in motion as soon as the signal at the output of the amplifier 15 disappears. If necessary, the leader of the section 1A behind the freshly destroyed weakened portion 3 is steered into the nip of the rollers 7, 8 so that such section can be advanced beyond the rollers 7, 8 and is separated from the next-following section as soon as the corresponding weakened portion 3 enters the space between the units 5, 6 and 7, 8. In the absence of a weakened portion 3 between the units 5, 6 and 7, 8, the speed of both units is the same.

As a rule, the signal which is generated by the transducer 16 is of short duration. The inertia of mechanical components of the regulating device 14 (the exact details of such device form no part of the invention) suffices to ensure that a weakened portion 3 between the units 5, 6 and 7, 8 breaks even though the interval of energization of the device 14 is extremely short. All that counts is to ensure that the temporary difference between the peripheral speeds of the rollers 7, 8 on the one hand and the peripheral speeds of the rollers 5, 6 on the other hand suffices to generate a tensional stress which destroys the weakened portion 3 between the monitoring means 16, 17 and the unit 7, 8. It is clear that the rollers 5, 6 need not be brought to a full stop as long as the just discussed tensional stress suffices to separate the preceding section 1A (which is advanced by the unit 7, 8) from the next-following section of the web 1.

It is also within the purview of the invention to accelerate the rollers 7, 8 whenever the monitoring means 16, 17 detects a weakened portion 3 and to leave the peripheral speeds of the rollers 5, 6 unchanged (or simultaneously with a reduction of the speed of the rollers 5, 6). This would merely amount to a simple reversal of functions without changing the basic concept of the invention.

Figure 2:
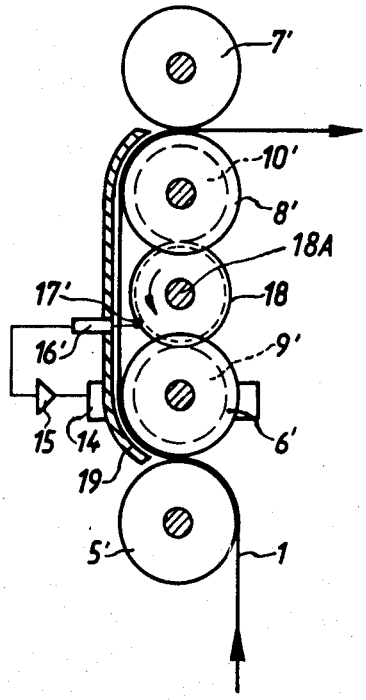
FIG. 2 is an end elevational view of a second apparatus, with certain parts shown in section.

FIG. 2 shows a second apparatus wherein the web 1 is transported upwardly and the axes of all four rollers 5', 6', 7', 8' are or can be located in a common plane. The web 1 is caused to change the direction of its movement during travel through the nip of the rollers 5', 6' of the second or lower advancing unit, and again during travel through the nip of the rollers 7', 8' forming part of the first or upper unit. The roller 6' (which drives the roller 5') is located above the roller 5', and the roller 8' (which drives the roller 7') is located below the roller 7'.

The distance between the rollers 6' and 8' (i.e., the distance between the two web advancing units of the transporting system of FIG. 2) is preferably less than the diameter of the roller 5', 6', 7' or 8'.

The rollers 6' and 8' are respectively connected to and coaxial with driver wheels 9', 10' which may constitute gears in mesh with a gear 18 on the output shaft 18A of an electric motor or another suitable prime mover. A suitably configurated sheet-like baffle 19 is provided to guide successive increments of the web 1 from the nip of the rollers 5', 6' into the nip of the rollers 7', 8'. Such baffle is needed to properly guide the leader of a fresh web 1 as well as to guide the leader of each section 1A upon separation of such section from the preceding section of the web.

The elements 16', 17' of the monitoring means scan the running web 1 in the space between the units 5', 6' and 7', 8' to actuate a regulating device 14 which serves to temporarily disconnect the wheel 9' from the roller 6' whenever it receives a signal from the amplifier 15, i.e., whenever the perforations of a weakened portion 3 of the web 1 advance between the light source 17' and the transducer 16'. As shown, the monitoring means 16', 17' can be installed (entirely or in part) in or on the baffle 19.

The regulating device 14 of FIG. 2 can accelerate the unit 7', 8' simultaneously with or instead of deceleration of the unit 5', 6' as long as the tensional stress upon a preceding section 1A suffices to separate such section from the next-following section before the corresponding weakened portion 3 reaches the nip of the rollers 7', 8'.

Figure 3:
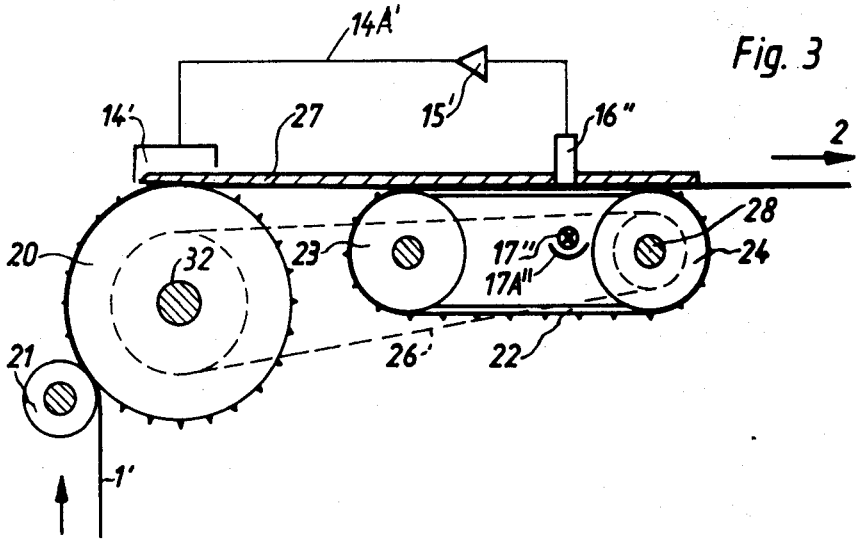
FIG. 3 is a partly side elevational and partly longitudinal vertical sectional view of a third apparatus.
Figure 4:
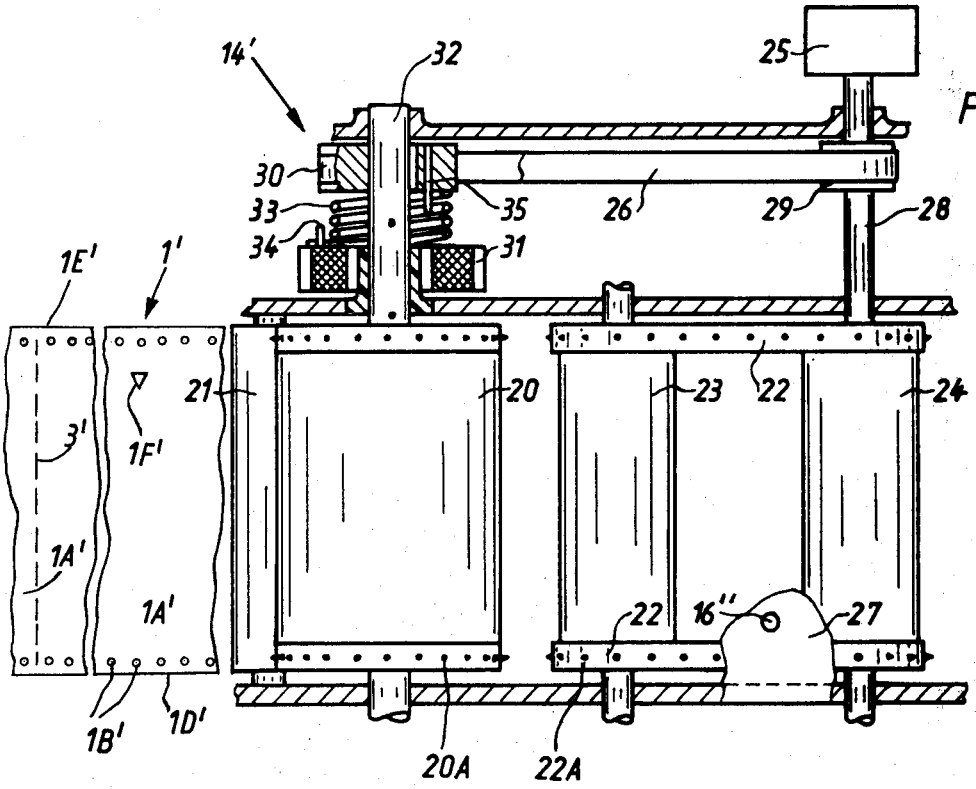
FIG. 4 is a partial plan and partial horizontal sectional view of the third apparatus.

FIGS. 3 and 4 show an apparatus wherein the smooth-surfaced rollers 5–8 or 5'–8' or analogous rotary elements of the two web advancing units shown in FIG. 1 or 2 are replaced by toothed rollers and toothed belts. The apparatus of FIGS. 3 and 4 is especially suited for separation of successive sections from the next-following sections of continuous webs 1' whose marginal portions have rows of holes 1B' for the teeth of toothed rollers (gears) and/or toothed belts. In such apparatus, the units including toothed rollers and/or belts perform a separating action in addition to guiding the web 1' along a predetermined path (i.e., the web is invariably held against lateral stray movements).

The unit 5, 6 or 5', 6' of the apparatus shown in FIG. 1 or 2 is replaced with a unit including a toothed roller or gear 20 which preferably cooperates with a smaller-diameter biasing roll 21 serving to urge successive increments of the running web 1', so that the teeth or projections 20A of the roller 20 invariably enter the oncoming holes 1B' of the web 1'. In the embodiment which is shown in FIGS. 3 and 4, the web 1' has two rows or holes 1B', namely, a row in each of its two marginal portions 1D', 1E'.

The first unit of the apparatus of FIGS. 3 and 4 comprises two endless belts 22 whose outer sides are formed with projections or teeth 22A adapted to enter the holes 1B' in the corresponding marginal portions 1D', 1E' of the web 1'. The belts 22 are trained over two pulleys 23, 24. The shaft 28 for the pulley 24 is the output element of a prime mover 25 (e.g., an electric motor) and carries a wheel 29 which drives a wheel 30 on the shaft 32 for the toothed roller 20. The wheel 30 can rotate on the shaft 32 and receives torque from a preferably toothed belt conveyor 26 driven by the wheel 29. A hold-down or biasing plate 27 is preferably provided at a level above the roller 20 and the upper reaches of the belts 22 to ensure that the projections 22A of the belts 22 invariably enter the oncoming holes 1B' of the running web 1'.

The monitoring means in the apparatus of FIGS. 3 and 4 comprises a photocell having a light source 17'' in front of a reflector 17A, and a transducer 16'' connected with a regulating device 14' by a conductor means 14A' containing an amplifier 15'. The web 1' has markers 1F' (e.g., in the form of apertures or slots) which are remote and distinct from the corresponding weakened portions 3'. Each weakened portion 3' is denoted and identified by a marker 1F', and such markers are detected by the monitoring means 16'', 17''. The markers 1F' are formed in the web 1' at a predetermined distance from (e.g., ahead of) the respective weakened portion 3'. The separation of two neighboring sections 1A' from each other takes place at a predetermined distance from the monitoring means 16'', 17'', namely, at a distance which matches that between a marker 1F' and the corresponding weakened portion 3'.

The regulating device 14' of FIG. 3 is designed to disconnect the roller 20 from the wheel 30 (i.e., from the prime mover 25) when the monitoring means 16'', 17'' detects a marker 1F'. It goes without saying that the regulating device 14' of FIGS. 3, 4 can be used in the apparatus of FIG. 1 or 2, or vice versa. The device 14' comprises an electromagnet 31 which is affixed to the shaft 32, i.e., it shares the angular movements of the roller 20 which constitutes or forms part of the second or rear advancing unit for the web 1'. The convolutions of a helical torsion spring 33 surround the shaft 32 between the electromagnet 31 and the wheel 30. One leg of the torsion spring 33 abuts against an axially parallel post 35 of the wheel 30, and the other end of this spring abuts against an axially parallel post 34 of the electromagnet 31.

In normal operation, the prime mover 25 drives the roller 20 at a peripheral speed which matches the speed of the belts 22. The electromagnet 31 is deenergized and merely serves as a means for transmitting torque from the wheel 30 (via torsion spring 33) to the shaft 32 and roller 20. When the electromagnet 31 is energized in response to an actuating signal from the amplifier 15', it builds up a magnetic field which brakes the electromagnet with the shaft 32 and roller 20 so as to bring the roller 20 to a momentary stop. The wheel 30 continues to rotate because the prime mover 25 is on and, therefore, the wheel 30 causes the torsion spring 33 to store energy. The web 1' breaks along the weakened portion 3' which is then located between the arrested or decelerated roller 20 and the belts 22.

The energization of electromagnet 31 is of short duration. When the amplifier 15' ceases to transmit a signal, the electromagnet 31 is deenergized without delay and the torsion spring 33 is free to dissipate energy so that, for a short interval of time, the speed of the electromagnet 31 exceeds the speed of the wheel 30.

As mentioned hereinabove, the speed of the first web advancing unit can be increased whenever a weakened portion advances into the space between the first and second units. Such increase in the speed of the first unit can be achieved by resorting to a transmission or by using discrete drive means for the first and second units so that the speed of the drive means for the first unit can be increased while the speed of the drive means for the second unit is reduced or remains unchanged.

As also mentioned hereinabove, it suffices to simply reduce the speed of the second unit below the speed of the first unit whenever a weakened portion is located between the two units, i.e., the speed of the second unit need not be reduced to zero. All that counts is to ensure that the speed of the first unit (7, 8, or 7', 8' or 22) exceeds the speed of the second unit (5, 6 or 5', 6' or 20) when a separating operation is to take place.

It is further within the purview of the invention to omit the photocell or a similar monitoring means when the weakened portions do not have any perforations, i.e., when a beam of light cannot penetrate through the weakened portions. In such instances, one can resort to reflection type photocells (e.g., to detect markers of the type similar to that shown in FIG. 4 but consisting of black dots on the web 1') or to utilize a much simpler device for actuation of the regulating means, e.g., to utilize a counter which transmits actuating signals at regular intervals when the speed of the web is constant and the length of each and every section of the web is the same. For example, the actuating means may include any device which can generate signals in response to transport of a predetermined length of a web, tape or strip therealong. Such length measuring device is preferably adjustable so that it can be used in connection with webs having longer or shorter sections. Signals which are transmitted by such length measuring device are used to actuate the regulating means so that the latter temporarily changes the speed of at least one unit in order to ensure that the speed of the first unit exceeds the speed of the second unit.

An important advantage of the improved apparatus is that the two web advancing units can be placed into close or immediate proximity of each other and that the distance between the two units need not be changed at all. Moreover, a monitoring means for detection of weakened portions (or of markers denoting the weakened portions) need not be adjusted when a web with longer sections is followed by a web with shorter sections or vice versa, especially if the monitoring means is or includes a photocell whose transducer is designed to generate signals in response to detection of light which is transmitted or reflected by the web.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for separating sections of an elongated web wherein the neighboring sections are connected to each other by spaced-apart elongated weakened web portions extending substantially transversely of the web, comprising means for transporting the web lengthwise in a predetermined direction, including a first advancing unit and a second advancing unit located behind said first unit, as considered in said direction; means for normally driving said units at the same speed; regulating means actuatable to vary the speed of at least one of said units so that the speed of said first unit exceeds the speed of said second unit while a weakened portion is located between said units; and means for monitoring the web and for actuating said regulating means whenever a weakened portion advances beyond said second unit but is still on its way toward said first unit.

2. The apparatus of claim 1, wherein said weakened portions have lines of perforations.

3. The apparatus of claim 1, wherein said sections are envelopes for photographic material.

4. The apparatus of claim 1, where said monitoring means includes a photosensitive detector.

5. The apparatus of claim 1, wherein said monitoring means is disposed between said units.

6. The apparatus of claim 1, wherein said monitoring means includes a detector which scans the web for the presence or absence of weakened portions and includes means for generating actuating signals in response to detection of weakened portions.

7. The apparatus of claim 1, wherein the web comprises indicia each of which is associated with a weakened portion and said monitoring means includes a detector having means for transmitting actuating signals in response to detection of indicia.

8. The apparatus of claim 1, wherein said driving means includes a common prime mover for said units.

9. The apparatus of claim 8, wherein each of said units includes a pair of rollers disposed at the opposite sides of the web and the axes of said rollers are disposed in a common plane.

10. The apparatus of claim 9, further comprising means for guiding the web from the nip of the rollers of said second unit into the nip of the rollers of said first unit.

11. The apparatus of claim 1, wherein said regulating means comprises a brake.

12. The apparatus of claim 11, wherein said brake is a magnetic brake.

13. The apparatus of claim 11, wherein said one unit is said second unit.

14. The apparatus of claim 1, wherein said regulating means includes means for reducing the speed of said second unit.

15. The apparatus of claim 1, wherein said regulating means includes means for arresting said second unit.

16. The apparatus of claim 1, wherein said second unit comprises at least one rotary web-engaging element.

17. The apparatus of claim 16, wherein said element includes a shaft and said drive means includes a driven wheel rotatably mounted on said shaft and a spring for transmitting torque from said wheel to said rotary element.

18. The apparatus of claim 17, wherein said regulating means includes an electromagnet which normally transmits torque from said spring to said element and is energizable on advancement of a weakened portion beyond said second unit but short of said first unit to thereby reduce the speed of said element to a speed which is less than the speed of said first unit.

19. The apparatus of claim 1, wherein said regulating means includes a magnetic brake for said second unit, said brake being energizable to thereby reduce the speed of said second unit, said monitoring means comprising means for energizing said brake on advancement of a weakened portion beyond said second unit but short of said first unit.

20. The apparatus of claim 19, wherein said energizing means includes a detector for generation of electric signals which are transmitted to said brake and means for amplifying said signals.

21. The apparatus of claim 1, wherein at least one of said units includes a pair of rollers disposed at the opposite sides of the web.

22. The apparatus of claim 1, wherein said web has at least one longitudinally extending row of holes and at least one of said units has projections entering the oncoming holes of the web.

23. The apparatus of claim 22, further comprising means for biasing the web against the unit having said projections so that the projections are compelled to enter the oncoming holes of the web.

* * * * *